United States Patent [19]

Stallkamp et al.

[11] Patent Number: 4,563,670

[45] Date of Patent: Jan. 7, 1986

[54] HIGH SPEED MULTIPLYING DIGITAL TO ANALOG CONVERTER

[75] Inventors: Richard W. Stallkamp, Dayton, Ohio; Marc L. Ranger, Clackamas, Oreg.

[73] Assignee: Tektronix, Inc., Beaverton, Oreg.

[21] Appl. No.: 561,400

[22] Filed: Dec. 14, 1983

[51] Int. Cl.[4] ..... G08C 9/00

[52] U.S. Cl. ..... 340/347 DA

[58] Field of Search ..... 340/347 DA; 364/841

[56] References Cited

U.S. PATENT DOCUMENTS

| | | | |
|---|---|---|---|
| 3,689,752 | 9/1972 | Gilbert | 364/841 |
| 4,017,720 | 4/1977 | Mattern | 340/347 DA |
| 4,092,639 | 5/1978 | Schoeff | 340/347 DA |
| 4,126,852 | 11/1978 | Baertsch | 340/347 DA |
| 4,309,693 | 1/1982 | Craven | 340/347 DA |

*Primary Examiner*—William M. Shoop, Jr.
*Assistant Examiner*—Sharon D. Logan
*Attorney, Agent, or Firm*—Francis I. Gray; Allston L. Jones

[57] ABSTRACT

A high speed four quadrant multiplier is current controlled and uses a high speed differential output current digital to analog converter. Independent adjustment of the multiplying factor without changing the DC offset is accomplished. Also a true zero input signal will cause a true zero output signal and the operation of the multiplier is extremely fast. The analog throughput of the multiplier is independent of the speed of the digital to analog converter.

3 Claims, 1 Drawing Figure

HIGH SPEED MULTIPLYING DIGITAL TO ANALOG CONVERTER

BACKGROUND AND SUMMARY

Previous high speed multiplying digital to analog converters did not allow the input signal to have a true zero value. Therefore one could not change the gain of the amplifier without changing the DC offset. This was a particular problem when dealing with auto convergence circuits of a color CRT circuit since changes must be done in real time, e.g. the screen cannot be blanked, changed and then redisplayed. Changes are done with the three color beams in motion and the display on.

Generally, previous multiplying digital to analog converters were not fast enough for this application and they did not allow a true zero input to produce a true zero output. Therefore, since one could not change the gain without altering the D.C. offset and the desired changes could not be done fast enough, the quality of the display presented was degraded during any change in the display. This was becoming more of a problem as displays became faster.

In accordance with the preferred embodiment of the present invention, a four quadrant multiplier (similar to the Gilbert Gain Cell of U.S. Pat. No. 3,689,752) is controlled by an 8-bit digital word. When the A.C. input is zero, the gain may be changed by changing the 8-bit digital word. There is no change in the D.C. offset of the output since a true zero input produces a true zero output in the preferred embodiment.

A differential input voltage is converted into differential currents. The differential currents are input to a high speed four quadrant multiplier which provides differential output signals. The gain of the multiplier and the DC offset are each independently controlled by a digital to analog converter in response to an eight bit digital word and a reference current. The preferred embodiment has improved speed of the analog throughput since the analog throughput speed is independent of the speed of the digital to analog converter.

DESCRIPTION OF THE PREFERRED EMBODIMENT

Figure 1:
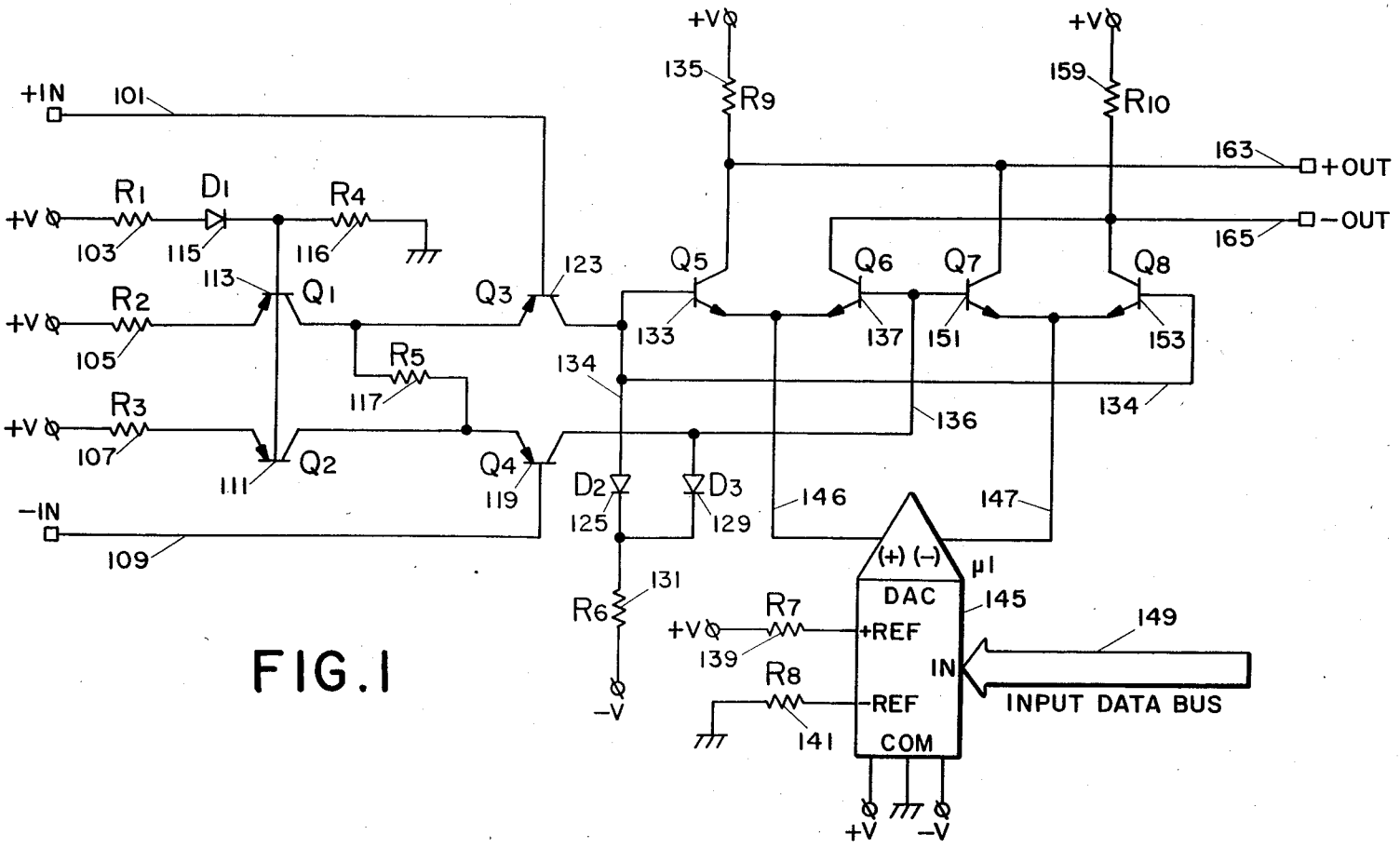
FIG. 1 is a schematic diagram of a high speed four quadrant multiplier using a digital to analog converter in accordance with the preferred embodiment.

Referring now to FIG. 1, there is shown a schematic diagram of a multiplying digital to analog converter in accordance with the preferred embodiment. Transistors 113 and 111 are biased by the voltage on the cathode of diode 115 and the currents through resistors 105 and 107, respectively. Diode 115 provides temperature compensation for the emitter-base junctions of transistors 111 and 113 by fixing the voltage drops across resistors 105 and 107. The currents flowing through the emitters of transistors 113 and 111 are therefore matched, thus providing first order temperature compensation within the matching of the emitter-base junction of transistors 111 and 113. Furthermore, transistors 111 and 113 are selected such that their base emitter junction voltages are matched.

Since the transistors 113 and 111 have essentially the same current flowing through them, then there is essentially the same current flowing through transistors 119 and 123. The emitter-base junctions of transistors 119 and 123 are also matched.

The currents from transistors 123 and 119 are applied to diodes 125 and 129, respectively. Since the currents applied are equal, the voltages across these diodes are also equal. Correspondingly, the voltage on line 134, which is applied to the bases of transistors 133 and 153, is equal to the voltage on line 136, which is applied to the bases of transistors 137 and 151. The transistors 133, 137, 151, and 153 are matched, the voltages at the emitter junction of transistors 133 and 137 and the emitter junction of transistors 151 and 153 are equal, as are the currents flowing through resistors 135 and 159. Therefore, the differential voltage between the signal +OUT on line 163 and the signal −OUT on line 165 is zero. Transistors 133, 137, 151 and 153 together with resistors 135 and 159 are in the Gilbert Gain Cell configuration.

A differential voltage between the signal +IN on line 101 and the signal −IN on line 109 will cause a proportional differential output voltage between the signal +OUT on line 163 and the signal −OUT on line 165. If the differential voltage between the signal +IN on line 101 and the signal −IN on line 109 is zero, then the differential voltage between the signals +OUT on line 163 and −OUT on line 165 will also be zero. This is irrespective of the output currents from digital to analog converter 145 which are flowing in lines 146 and 147. The currents flowing in lines 146 and 147 control the DC voltage offset values of the signals on lines 163 and 165 but it does not offset the differential voltage between the two signals.

The differential output voltage of the signals +OUT and −OUT on lines 163 and 165, respectively, will be zero so long as equal currents are provided by transistors 119 and 123, and diodes 125 and 129 have been matched, thus producing equal voltages across diodes 125 and 129. Those equal voltages are therefore at the bases of transistors 133, 137, 151 and 153. If the value of the voltage on the bases of transistors 137 and 151 is equal to the voltage on the bases of transistors 133 and 153 then the current flowing through resistors 135 and 159 is equal and the voltages on lines 163 and 165 are equal. This will occur regardless of the currents flowing in lines 146 and 147 from DAC 145. This is because any current change in line 147 would equally be reflected in the collectors of transistors 151 and 153. Similarly, any current flow change in line 146 will be equally reflected at the collectors of transistors 133 and 137. This complementary configuration provides that the common mode voltage will not change, but the DC output voltage for both the voltage signals, +OUT and −OUT, on lines 163 and 165 will both move together in a positive or negative direction in response to shifts in the currents in lines 146 and 147 from DAC 145. However, the differential voltage between the signals on lines 163 and 165 will not be changed.

DAC 145 (e.g. AD1408 by Analog Devices) is a complementary current source digital to analog converter. If current is subtracted from the minus output coupled to line 147, the same amount of current will be added to the plus output coupled to line 146. Similarly, a reduction in current output from the plus output coupled to line 146 will cause a corresponding increase in current from the minus output coupled to line 147. In other words the sum of the currents in lines 146 and 147 is always equal to the input reference current of DAC 145 with the distribution of the current split between lines 146 and 147 determined by the data word entered on bus 149. The reference current being divided by DAC 145 is determined by the bus voltage +V and the values of resistors 139 and 141 which are connected to the +REF and the −REF terminals of DAC 145. Since the collectors of transistors 133 and 151 are tied together, and the collectors of transistors 137 and 153 are tied together, the sum of the currents flowing in resistors 135 and 159 is unchanged. Since the value of the reduction of the current flow through transistor 153 is matched at the same time by an equivalent current increase through transistor 137, no net change in current flow through resistor 159 occurs. Similarly, the coupling of the collectors of transistors 133 and 151 maintains a relatively constant current flow through resistor 135 despite the balanced current changes occurring in lines 146 and 147. Additionally, the sum of the currents through resistors 135 and 159 remains fixed regardless of the values of voltages +IN and −IN and the reference current split between lines 146 and 147.

When the differential voltage between the signals +IN and −IN on lines 101 and 109 is changed, the voltages at the emitters of transistors 119 and 123 will be proportionally changed.

If the voltage +IN on line 101 is changed to be more positive than the voltage −IN on line 109, then a portion of the current flowing through transistor 111 flows through resistor 117, transistor 123 and eventually diode 125 resulting in a lesser current flowing through diode 129. This change in the currents through diodes 125 and 129 translates into a lower voltage on the bases of transistors 137 and 151 and a corresponding increase in the voltage on the bases of transistors 133 and 153. The currents through transistors 133, 137, 151 and 153 thus change differentially and cause differential currents to flow through resistors 135 and 159. The voltage signals, +OUT and −OUT, on lines 163 and 165, respectively, are thus changed differentially in response to the differential change between the voltage signals, +IN and −IN, on lines 101 and 109. As long as the currents flowing through diodes 125 and 129, and in lines 146 and 147, maintain their relative values, the voltage signals, +OUT and −OUT, on lines 163 and 165, respectively, will also maintain proportional relative values.

A typical DAC 145 will accept $2^n$ digital words to control the split of the reference current between lines 146 and 147. If the reference current split between lines 146 and 147 is unequal, then one of the differential transistor pairs 133 and 137 or 151 and 153 will handle more current than the other. For example, if $$I_{146}=2I_{147}, \tag{1}$$

the total current flowing through transistors 133 and 137 will be twice the current flowing through transistors 151 and 153. If the voltages on the anodes of diodes 125 and 129 are the same, the result of the change in the $I_{146}$ and $I_{147}$ currents will only be a change in the DC offset voltage in the +OUT and −OUT signals on lines 163 and 165, there will be a zero differential voltage between lines 163 and 165, and each of the transistors in transistor pairs 133 and 137, and 151 and 153 will conduct 50% of $I_{146}$ and $I_{147}$, respectively. Thus, the current flowing through resistors 135 and 159 will be $$I_{R135}=I_{R159}\cong 0.5I_{146}+0.5I_{147}=1.5I_{147} \tag{2}$$

for $I_{146}=2I_{147}$ where $$I_{REF}=3I_{147}$$

If $$I_{146}=0.5I_{147} \tag{3}$$

then $$I_{R135}=I_{R159}\cong 0.5I_{146}+0.5I_{147}=0.75I_{147} \tag{4}$$

where $I_{REF}=1.5I_{147}$

However, if a differential voltage is applied to lines 101 and 109 with the DAC 145 output current split as in equation (1) above a different result is achieved. Assume that the differential voltage applied to lines 101 and 109 causes transistors 133 and 153 to conduct 75% of the current through their respective transistor pair. Thus, $$I_{R135}\cong 0.75I_{146}+0.25I_{147}\cong 0.75\times 2I_{147}+0.25I_{147}=1.75I_{147} \tag{5}$$

and $$I_{R159}\cong 0.25I_{146}+0.75I_{147}\cong 0.25\times 2I_{147}+0.75I_{147}=1.25I_{147} \tag{6}$$

each for $I_{147}=2I_{147}$.

Alternatively, if $I_{146}=0.5I_{147}$ $$I_{R135}\cong 0.625I_{147} \tag{7}$$

$$I_{R159}\cong 0.875I_{147}. \tag{8}$$

Finally, by reversing the differential voltage polarity on lines 101 and 109 as discussed above, we get $$I_{R135}\cong 1.25I_{147}$$

$$I_{R159}\cong 1.75I_{147} \tag{9}$$

for $I_{146}=2I_{147}$ and $$I_{R135}\cong 0.875I_{147}$$

$$I_{R159}\cong 0.625I_{147} \tag{10}$$

for $I_{146}=0.5I_{147}$.

Thus, it can be seen that by reversing the current split between lines 146 and 147, or the polarity of the differential input voltage, the opposite effect is achieved in the output on lines 163 and 165 yielding a four quadrant multiplying effect.

Multiplication is achieved in this circuit as a result of the exponential or logarithmic characteristic of the transistors. In each of the transistor pairs 133 and 137 or 151 and 153, as the current $I_{146}$ or $I_{147}$ is varied, the differential output produced in response to the differential base voltage input, is multiplied in proportion to the current $I_{146}$ or $I_{147}$. As a result of the cross-coupling of the collectors of each of the transistor pairs 133 and 137, and 151 and 153 the four-quadrant multiplication result is achieved. In other words, multiplication is achieved through the addition of the logarithms of the various currents.

We claim:

1. A high speed multiplier circuit for adjustment of its differential output voltage independent of the selection of the D.C. voltage offset of the output signals, said circuit comprising:

a first pair of control devices each having an output terminal, a control terminal, and a common terminal, said common terminals being connected together;

a second pair of control devices each having an output terminal, a control terminal, and a common terminal, said common terminals being connected together;

output means cross-coupling the output terminals of the first and second pairs of control devices for providing differential output signals;

means for cross-coupling the control terminals of the first and second pairs of control devices;

means for differentially applying currents to the connected common terminals of the first and second pairs of control devices to independently produce a selected D.C. offset voltage in the differential output signal;

a pair of input devices each having an output terminal, an input terminal, and a current receiving terminal, said input terminals being disposed to receive an input signal differentially therebetween, and said current receiving terminals being disposed to receive substantially equivalent currents;

a current coupling device interconnected between the current receiving terminal of each of the input devices;

a pair of diode means each being coupled to a different one of the cross-coupled control terminals of the first and second pairs of control devices and to a different one of the output terminals of the pair of input devices for differentially applying signal representative of the differential input signal to the cross-coupled control terminals of the first and second pairs of control devices.

2. A circuit as in claim 1 wherein said differential current application means includes a complementary current source digital to analog converter.

3. A circuit as in claim 1 wherein the differential voltage application means further includes a matched pair of temperature compensated current sources coupled to the current receiving terminals of the pair of input devices.

* * * * *